US008856976B1

(12) United States Patent
Niedzielski, III

(10) Patent No.: US 8,856,976 B1
(45) Date of Patent: Oct. 14, 2014

(54) PORTABLE URINE SHIELD

(71) Applicant: Joseph Edward Niedzielski, III, Milltown, WI (US)

(72) Inventor: Joseph Edward Niedzielski, III, Milltown, WI (US)

( * ) Notice: Subject to any disclaimer, the term of this patent is extended or adjusted under 35 U.S.C. 154(b) by 40 days.

(21) Appl. No.: 13/837,177

(22) Filed: Mar. 15, 2013

(51) Int. Cl.
*E03D 9/00* (2006.01)
*A47K 13/24* (2006.01)

(52) U.S. Cl.
CPC ..... *A47K 13/24* (2013.01)
USPC ..... 4/300.3

(58) Field of Classification Search
USPC ..... 4/300.3, DIG. 5
See application file for complete search history.

(56) References Cited

U.S. PATENT DOCUMENTS

| | | | | | |
|---|---|---|---|---|---|
| 2,489,967 | A | * | 11/1949 | Lavine | 4/263 |
| 2,980,919 | A | | 10/1957 | Otto | |
| D245,425 | S | | 8/1977 | Annis | |
| 4,348,776 | A | * | 9/1982 | Sarjeant | 4/300.3 |
| 5,117,512 | A | | 6/1992 | Bressler | |
| D369,856 | S | | 5/1996 | Lucido et al. | |
| D394,900 | S | | 6/1998 | Kang | |
| 5,815,851 | A | | 10/1998 | Perry | |
| D405,168 | S | | 2/1999 | Henry | |
| 6,385,785 | B1 | | 5/2002 | Linden | |
| 7,017,198 | B2 | | 3/2006 | Conn et al. | |
| 7,178,177 | B1 | | 2/2007 | Valencia | |
| 7,921,478 | B1 | | 4/2011 | Vanini | |
| 2004/0237181 | A1 | * | 12/2004 | Atkins-Williams | 4/300.3 |
| 2005/0198727 | A1 | * | 9/2005 | Conn et al. | 4/300.3 |
| 2012/0096633 | A1 | * | 4/2012 | Escudero et al. | 4/300.3 |

* cited by examiner

*Primary Examiner* — Huyen Le
*Assistant Examiner* — Christine Skubinna
(74) *Attorney, Agent, or Firm* — Berggren Law Offices, LLC; William R. Berggren

(57) ABSTRACT

A urine shield comprising a unified single piece flexible plastic sheet with a width that are sufficient to permit the sheet to partly encircle the bowl of the toilet and compression-fitted to the inside of the bowl without any use of fixtures. The sheet includes a left portion having a bottom left end, a center portion, a right portion having a bottom right end. The sheet also comprises two flanges that slope outward from the bottom of the left portion and right portion with a length that decreases as the flange extends from the bottom end of each portion to the center portion. The flanges also extend at an angle less than perpendicular but more than parallel from the each portion. A method of using this urine shield is also provided.

19 Claims, 4 Drawing Sheets

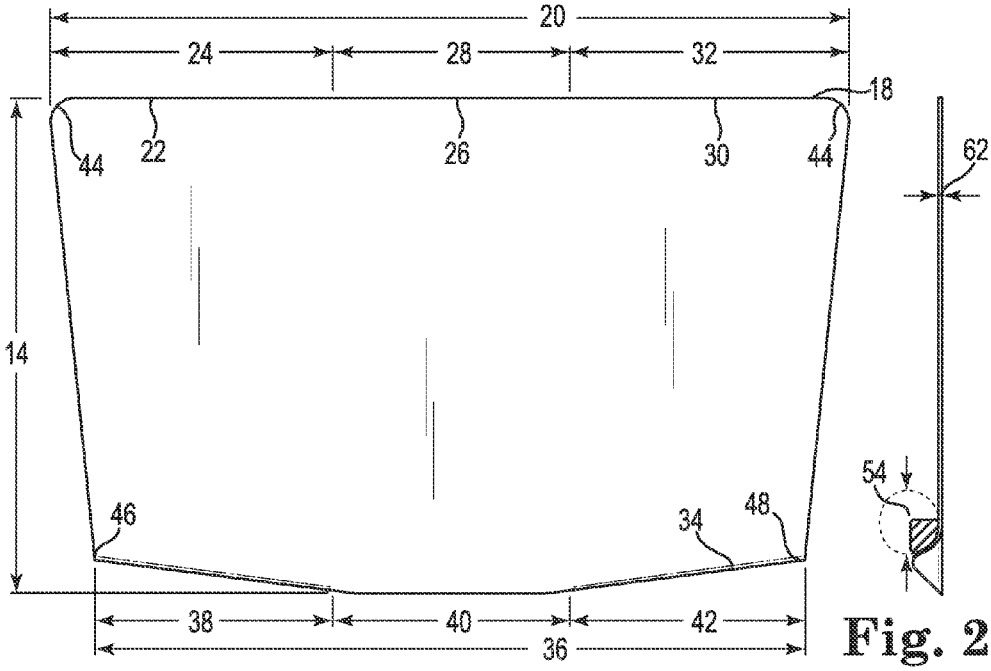
Fig. 2A
Fig. 2C
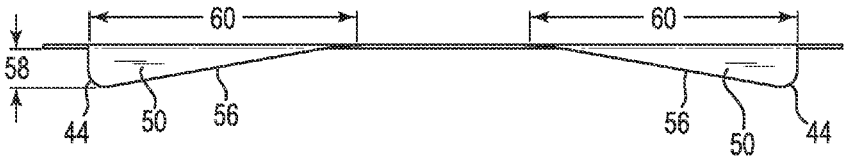
Fig. 2B

PORTABLE URINE SHIELD

FIELD OF THE INVENTION

This invention relates to a portable urine shield for toilets.

BACKGROUND OF THE INVENTION

There is a need for a portable urine shield for toilets that is ease to quickly install and remove, to clean, and to prevent urine-tainted water from splashing onto toilet bowl surfaces other than the inside of the toilet bowl.

Young male children are particularly prone to missing the toilet bowl when urinating. This can cause a frequent need on the part of parents to clean the toilet bowl surface outside the inside bowl and the surrounding floor and toilet seats and covers.

Many urine shields are known to the art. However, they have disadvantages that prevent them from addressing the problem in a satisfactory manner. Some have fasteners that require time and sometimes tools to attach, and are not easy for a child to install and remove by himself. Others have protrusions on the outside that are a source of gathered germs and are difficult for a child to clean. Still others have gaps that permit urine-tainted water to splash up behind the shield onto the toilet bowl outside its inner bowl. There is still a need for a portable urine shield for toilets that is ease to quickly install and remove, to clean, and to prevent urine-tainted water from splashing onto toilet bowl surfaces other than the inside of the toilet bowl

SUMMARY OF THE INVENTION

I have invented a portable urine shield or toilets that prevent urine-tainted water from splashing onto toilet bowl surfaces other than the inside of the toilet bowl, and is easy to quickly install, remove, and clean. Specifically I have invented a urine shield for use with a toilet bowl with a front, a rear, a diameter, a top surface with a ledge and curved interior side surface beginning under the ledge. The urine shield comprises a unified single piece flexible plastic sheet with a top and a bottom, and a top width and a bottom width that are sufficient to permit the sheet to partly encircle the bowl of the toilet. The sheet includes four corners regions, a left portion having a bottom left end, a center portion, a right portion having a bottom right end, and a height. The sheet has a flexibility permit it to be to be compression-fitted to the inside of the bowl without any use of fixtures, affixed ledgers, or right angle protrusions. The sheet also comprises a left flange and a right flange, and a thickness. The left flange slopes outward from the bottom of the left portion to the center portion with a length that decreases as the flange extends from the bottom left end to the center portion and extends at an angle less than perpendicular but more than parallel from the left portion. The right flange slopes outward from the bottom of the right portion to the center portion with a length that decreases as the flange extends from the bottom right end to the center portion and extends at an angle less than perpendicular but more than parallel from the right portion. The thickness is sufficiently thin to permit hand bending of the sheet to fit into the toilet bowl and sufficiently thick to permit relaxation of the sheet to compression-fit it in the bowl.

I have also invented a method of using the urine shield comprising three steps. The first is to provide a urine shield as described above. The second is to press the sides of the sheet inward sufficiently to fit the flanges within the bowl of the toilet while lowering the bottom of the urine shield below the top ledge of the toilet. The third step is to release the shield to permit at least a portion of each flange to catch under the top ledge and the center portion to settle against surface of the toilet bowl at the rear of the toilet bowl.

My urine shield is more sanitary, durable, and portable. Lack of fixtures or protruding ledges or clamps makes it easier to clean with simple rinsing, decrease wear and deterioration, and minimizes sites of germ collection. The unified simple structure makes it easy and quick for an adult or child to place the urine shield embodiment of the invention on a toilet. Also, the simple structure makes it easy for an adult or child to rinse and store it for later use. In addition, such a structure is quite durable with no parts for accelerated wear and deterioration because it is around children and acidic urine.

BRIEF DESCRIPTION OF THE DRAWINGS

One or more features or preferred forms of the invention are described in the accompanying drawings. The drawings are described briefly below.

FIG. 2 is a front view (A), side view (B) and top view (C) of one embodiment that is straight.

DETAILED DESCRIPTION

Figure 1:
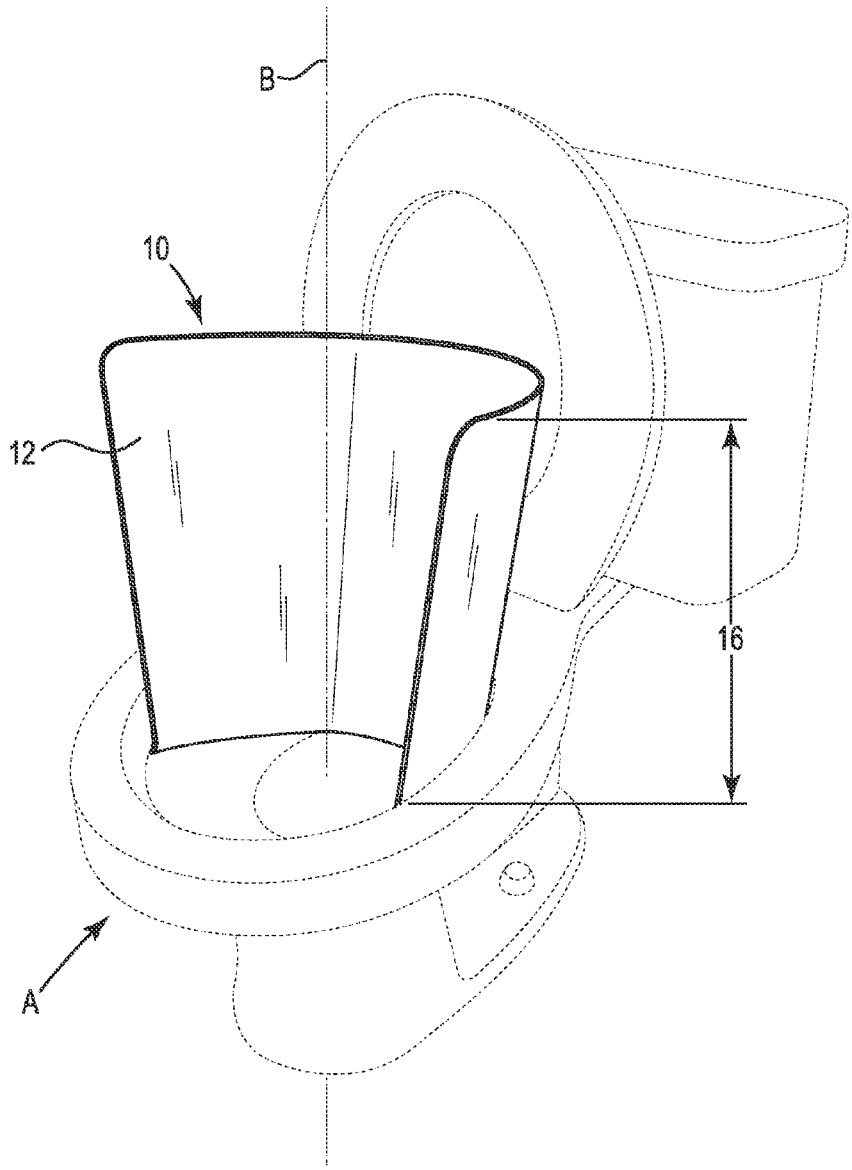
FIG. 1 is a perspective of an embodiment of the invention releasably attached to a toilet.

While this discussion refers to a male child, it also is understood that it applies to a male adult that is mentally challenged so that he no longer exercises conventional behavior when urinating in a toilet. Such male adults could include, for example, those with Alzheimer Disorder and those who are severely retarded or with severe Downs Syndrome.

Sometimes training a male child to urinate into a toilet in a sanitary manner can be difficult. His attention span may not be focused and the urgency to pass urine may be overwhelming. Often a male child waits because of attention on something else until the urgency to pass urine is intense that he has little time to reach the toilet and not pass urine in his clothing. Then he quickly rushes into a bathroom to urinate. In the heat of moment the young male child needing to urinate may not concentrate enough to have his urine stay in the inner bowl of a toilet. Instead, it may splash on the toilet top rim or even outside the toilet onto the floor or on neighboring walls, cabinets, and other fixtures. This behavior results in an adverse sanitary situation. In these situations, a urine shield is appropriate.

However, the urine shield must be easily portable to best meet the needs of the above situation. Often the urine shield must be removed. Examples of such situations include, for example, when the user of the toilet is female or is male but needs to defecate. Thus, it is detrimental to have urine shields affixed to toilets in ways that require a significant amount of time to remove them.

In addition, urine shields should minimize collection of urine on ledges, attachment fixtures, and protrusions. Such protrusions are sites of germs and are more difficult to clean; especially for a young male child with a poor attention span.

They are also sites for accelerated wear and early breakage. Young children tend to be more careless about material objects. In addition, urine is acidic and accelerates wear and deterioration of fixtures.

Also, urine shields should minimize adverse splashing of urine containing water onto surfaces other than the inside surface of a toilet bowl. Elements used to affix the urine shield to the top surface of a toilet should not have spaces or gaps that allow urine-containing water to splash up on the outside of the urine shield or reach the top surface of the toilet.

Moreover, there is a need for a urine shield that can be used satisfactorily on all toilets. Some toilets have bowls with tops that are circular. Others are oval. Still others have various diameters with no universal standard diameter. Thus, a satisfactory urine shield should be flexible and not rigid.

Urine shields have been known for years but have not addressed the problems discussed above in a satisfactory manner. U.S. Pat. No. 2,980,919 discloses a urinal attachment that is not designed to be portable or easy to clean. U.S. Pat. No. D245,425 discloses a rigid urine shield that may result in adverse splashing and has ledges that are hard-to-clean-sites for germs. U.S. Pat. No. 5,117,512 discloses a urine shield with fastening elements that significantly slow down the time for installation and removal, and are sites for wear and easy breakage. U.S. Pat. No. D369,856 discloses a urine shield with fixtures and ledges. U.S. Pat. No. D394,900 discloses a urine shield with fixtures and screws. U.S. Pat. No. 5,815,851 discloses a non-portable urine shield that does not appear to have sufficient height to satisfactorily minimize adverse effects of misdirected urine streams from a young male. U.S. Pat. No. D405,168 discloses a urine deflector that does not seem appropriate for use with toilets as it does not deflect urine streams projected above the top surface of a toilet but appears to be directed inside the toilet bowl. U.S. Pat. No. 6,385,785 discloses a urine shield with fixtures that mount to the less stable toilet seat. U.S. Pat. No. 7,017,198 discloses a urine shield with a rod fixture for suspending targets for a male child to direct his urine stream. U.S. Pat. No. 7,178,177 discloses a urine shield with flanges that appear unable to achieve a secure attachment to the underside of the toilet bowl ledge and bumpers that are sites for wear and difficult cleaning actions. U.S. Pat. No. 7,921,478 discloses a urine shield with fixtures that mount a portion of the inside of the urine shield to the outside of the top surface of the toilet bowl; increasing adverse splashing as will as providing a site for germs and wear.

My invention has two aspects, an article aspect and a method aspect. The article aspect is a portable urine shield for toilets that prevent urine-tainted water from splashing onto toilet bowl surfaces other than the inside of the toilet bowl, and is easy to quickly install, remove, and clean. Specifically I have invented a urine shield for use with a toilet having a toilet bowl with a front, a rear, a diameter, a top surface with a ledge and curved interior side surface beginning under the ledge.

The urine shield comprises a unified single piece flexible plastic sheet with a top and a bottom, and a top width and a bottom width that are sufficient to permit the sheet to partly encircle the bowl of the toilet. The sheet includes four corners regions, a left portion having a bottom left end, a center portion, a right portion having a bottom right end, and a height. The sheet has a flexibility permit it to be to be compression-fitted to the inside of the bowl without any use of fixtures, affixed ledgers, or right angle protrusions. The sheet also comprises a left flange and a right flange, and a thickness. The left flange slopes outward from the bottom of the left portion to the center portion with a length that decreases as the flange extends from the bottom left end to the center portion and extends at angle less than perpendicular but more than parallel from the left portion. The right flange slopes outward from the bottom of the right portion to the center portion with a length that decreases as the flange extends from the bottom right end to the center portion and extends at angle less than perpendicular but more than parallel from the right portion. The thickness is sufficiently thin to permit hand bending of the sheet to fit into the toilet bowl and sufficiently thick to permit relaxation of the sheet to compression-fit it in the bowl.

The plastic sheet is made of flexible plastic that has some stiffness, water resistance, and urine resistance properties. The plastic should be rigid enough to be able to stand upright on its own in a toilet but flexible enough to bend and relax to compression-fit inside the rim of the toilet bowl. In addition, the material must be resistant to softening or deforming under the water temperature of a bathroom bathtub or shower—typically up to 110 degrees F. or 43 degrees C. Suitable plastics include, for example, low density polyethylene (LDPE)—stable up to 176 degrees F. or 80 degrees C., high density polypropylene (HDPE)—stable up to 230 degrees F. or 110 degrees C., and polypropylene (PP)—stable up to 572 degrees F. or 300 degrees C. Flexibility is also influenced by the thickness of the plastic sheet. Thicknesses may depend on the particular plastic used. Some embodiments made of some types of LDPE may have suitable flexibility and stiffness at thicknesses that range between 1/32 inch (0.8 millimeters (mm)) and 3/32 inch (2.4 mm). Other embodiments may have thicknesses that are thicker or thinner than mentioned above depending on the grade and type of plastic used.

The urine shield includes two flanges, a left on and a right one. As stated previously, each flange slopes outward from the bottom of their respective left portion or right portion to the center portion with a length that decreases as the flange extends from the bottom end of the respective portion to the center portion and extends at angle less than perpendicular but more than parallel from the respective portions. The widths of each portion may be the same or different. The width of the left portion may be the same as the width of the right portion but that is not required. The slope has a curvature that eliminates any sharp bends that are difficult to clean and provide stress points that may accelerate adverse wear, deterioration and breakage of the urine shield. In some embodiments, the slope of the bend is similar to the arc of a circle having a diameter of between 1 inch (2.5 cm) and 2 inches (5 cm). In some embodiments, the bend is similar to a circle having a smaller diameter, a larger diameter, or the melding of circles of multiple diameters.

The flanges extend at angle less than perpendicular but more than parallel from the respective portions. This is to direct the deposited urine downward toward the toilet bowl and not provide a surface for urine or urine-containing water to collect. It also enhances cleaning efforts.

The flanges extend outward from the plane of their respective portions by a length to permit engagement of the flange with the underside of the ledge of the toilet bowl. The length should not be long enough to adversely contact the wall of the toilet bowl and push the urine shield an excessive amount of distance away from the side of the toilet. An excessive amount results in enough of a decrease opening of the urine shield that is presented to the male child to adversely affect the usefulness of the urine shield. Some embodiments have a length that is at least 0.5 inches (13 mm) with a n angle of 45 degrees from vertical. Some embodiments have a length that is at least 0.5 inches (13 mm) but not greater than 1.5 inches (37 mm) with a n angle of 45 degrees from vertical. The minimum and maximum lengths of the flanges depend on the angle that the flange extends downward from its portion of the plastic sheet. Higher lengths may be more beneficial with smaller angles.

The plastic sheet has a height and width in addition to its previously discussed thickness. While some embodiments are substantially rectangular in shape, others may vary from that shape with heights and widths that are not uniform.

The height has two functional restraints. It should be sufficient to minimize adverse urine splashing and should be not enough to become unwieldy, especially in the hands of a child. A suitable maximum height above the top surface of a toilet bowl has been found to be at least 8 inches (20 centimeters (cm)) and not more than 16 inches (40 cm). Some embodiments have a total height at a longest measurement of at least 12 inches (25 cm) and not more than 20 inches (50 cm) to minimize deposit of urine outside the toilet bowl and minimize the urine shield's unwieldiness during attachment to the toilet, removal from the toilet and cleaning.

Flanges may be tapered from the end of the bottom of the respective portion to the center portion. Tapering permits a more intimate contact of the bottom of the urine shield with the surface of the toilet bowl. This decreases the chance of urine or urine-containing water from being deposited on the outside of the urine shield and outside the toilet bowl.

The width of the plastic sheet should be enough to allow the bottom of the center portion to contact the inner surface of the bowl, both flanges to catch under the ledge of the top surface of the toilet bowl. It should also provide an opening to the front of the toilet sufficient for the male child to be able to urinate into the toilet bowl. Some embodiments have a width that provides an opening of at least 25 percent of the diameter of the top of the toilet bowl and no more than 50 percent of the diameter of the top of the toilet bowl. Some embodiments have a width that provides an opening of at least 30 percent of the diameter of the top of the toilet bowl and no more than 40 percent of the diameter of the top of the toilet bowl.

The sheet may be substantially flat or may be pre-bent into a curved state about a vertical axis. The plastic sheet has three vertical portions, a left one, a center one and a right one. The left and right portions have flanges at their bottoms. Thus, the left and right have limited flexibility for bending the sheet to fit in the toilet bowl and most of the bending occurs in the center portion. The bending may be easier if the left and right portions are pre-bent slightly down their middles with the bend decreasing to zero as one goes from top to bottom where the flange lies. The bending may also be easier when the sheet between the center portion and each side portion is pre-bent in a rounded manner to minimize stress points. In any cane, the resulting pre-bent state should not have a curvature with a diameter that is greater than that of the top of the toilet bowl to permit resulting compressive force to hold the urine shield in place in the bowl. Some embodiments have a width of between 20 inches (50 cm) and 30 inches (75 cm).

The width may decrease from top to bottom of the sheet. This enhances the splash protecting feature of the urine shield while maintaining a wide enough opening for the male child to access the toilet easily. Some embodiments have a width of between 20 inches (50 cm) and 30 inches (75 cm) at the top that decreases toward the bottom from between 10 and 25 percent.

The corners of plastic sheet may be rounded to minimize adverse injury when a male child handles. Some embodiments have the right angle corners cut off. Some embodiments have the right angle corners rounded.

The urine shield may have one or more holes in the sheet, typically near the top. A hole would be useful for such activities as, for example, suspending the urine shield from a hook affixed to a tile wall over a bathtub for storage. A pair of holes, typically in the form of substantially horizontal slits or flat ovals, may be used as handholds as well as for suspending the urine shield from a hook or other suspending element.

The urine shield may have a target indicia on the lower center portion. This serves as a humorous aspect for the male child. It creates a game-like aspect that has teaching elements. The child is taught to hit the target with his stream of urine.

The article aspect is illustrated further in FIGS. 1-6. All similar elements are numbered the same even if they are for different embodiments. FIG. 1 is a perspective of an embodiment of the invention releasably attached to a toilet. A urine shield (10) is shown placed in a toilet (A) in a manner that is suitable for use by a male child that is ready to urinate. Urine shield 10 is curved about a vertical axis of curvature of the inside ledge of the toilet bowl (B).

FIG. 2 is a front view (2A), side view (2B) and top view (2C) of one embodiment that is substantially straight. A plastic sheet (12) has a height (14), a height above the top of the toilet bowl (16), a top (18) with a top width (20), a left portion (22) with a top width (24), a center portion (26) with a top width (28), and a right portion (30) with a top width (32). Plastic sheet 12 also has bottom (34) with a bottom width (36), a width of the bottom left portion (38), a width of the bottom center portion (40), and a width of the bottom right portion (42). Each of the four corners (44) are smoothed. Bottom 38 has a bottom left end (46) and a bottom right end (48). A left flange (50) and a right flange (52) are connected to the bottom each by an arc having a shape similar to a circle with a diameter of (54). Each flange 50,52 has a tapered edge (56), an edge length (58) that extends outward from the plane of left portion 22 and right portion 30, and a maximum edge width (60) near bottom left end 46 and bottom fight end 48. The plastic sheet has a thickness (62).

Figure 3:
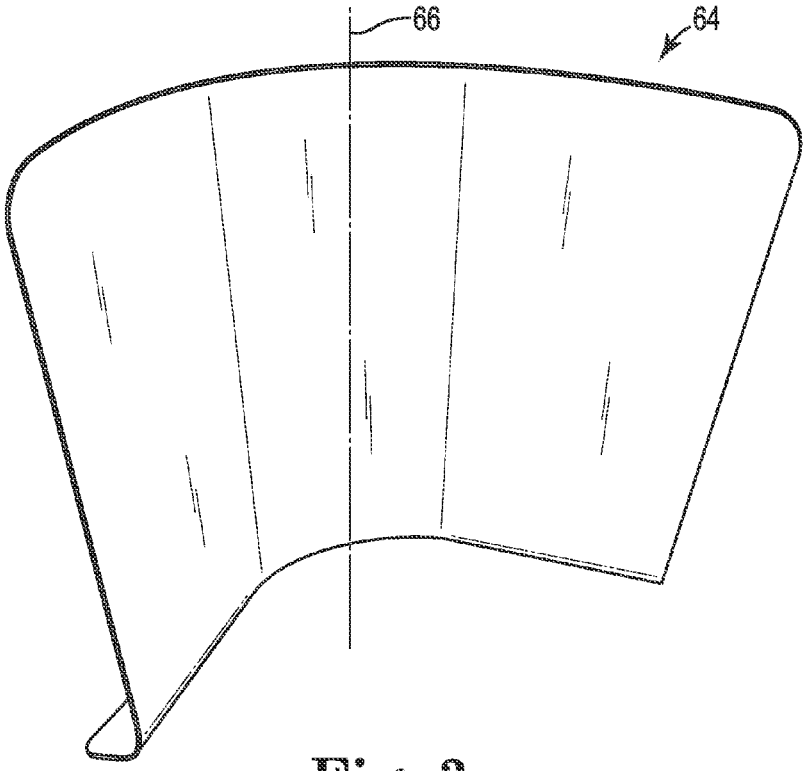
FIG. 3 is a perspective view from the upper left of one embodiment that is curved.

FIG. 3 is a perspective view from the upper left of one embodiment that is curved. In this embodiment the plastic sheet is pre-bent with a curve (64) that has an approximate vertical axis of curvature (66) of the urine shield 10 outside the toilet and at rest. The portions are wider at the bottom than at the top.

Figure 4:
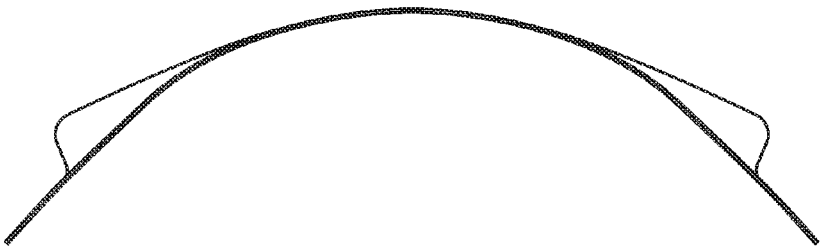
FIG. 4 is a top angled view of the embodiment shown in FIG. 3.

FIG. 4 is a top angled view of the embodiment shown in FIG. 3 to more clearly show the curvature looking down the plane of left portion 22, center portion 26 and right portion 30.

Figure 5:
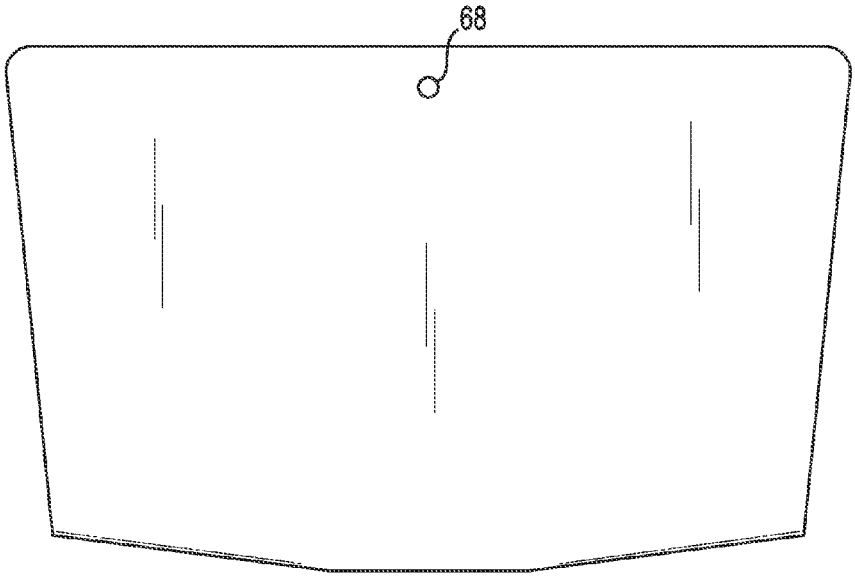
FIG. 5 is a front view of a straight embodiment with a hole for hanging on a hook.

FIG. 5 is a front view of a straight embodiment with a hole (68) for hanging on a hook.

Figure 6:
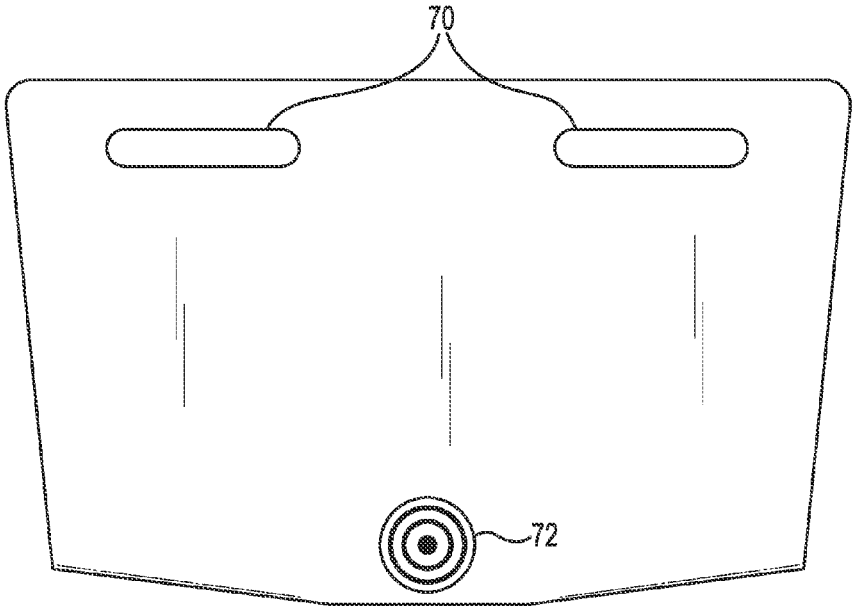
FIG. 6 is a front view of a straight embodiment with two holes for hands to manipulate the invention is use.

FIG. 6 is a front view of a straight embodiment with two holes (70) for hands to manipulate the invention is use. This embodiment also has a target indicia (72) affixed to the lower part of the center portion.

The article described above can be made by conventional manufacturing techniques that are well known to the plastics forming industry. Such techniques include, for example, injection molding, vacuum molding, and cutting and heating rod molding of sheet plastic.

I have also invented a method aspect. The method of using the urine shield comprising three steps. The first is to provide a urine shield as described above. The second is to press the sides of the sheet inward sufficiently to fit the flanges within the bowl of the toilet while lowering the bottom of the urine shield below the top ledge of the toilet. The third step is to release the shield to permit at least a portion of each flange to catch under the top ledge and the center portion to settle against surface of the toilet bowl at the rear of the toilet bowl.

Some embodiments of the method also includes three additional the steps. The fourth step is to press the sides of the sheet inward sufficiently to remove the flanges from under the top ledge of the toilet bowl. The fifth step is to remove the sheet from the toilet bowl. The sixth step is to rinse the sheet with water.

Rinsing can be by any method that results in a cleaned article. The article may be placed under the water of a shower or bathtub faucet. The water may be of any temperature. Hot water would clean the surface better than cold water but may present adverse safety situations to the male child. The article may be placed in a standing pan of water containing cleaning compounds before it is run under a faucet.

In situations where the urine shield further includes at least one hole, embodiments of the methods previously discussed may also include the seventh step to suspend the rinsed sheet on the hook for drying. Hooks with suction cups may be attached to vertical tile surfaces in shower stalls or above bathtubs.

Some method embodiments that comprise urine shields that are pre-bent into a curve larger than the curve of the circumference of the top of a toilet bowl may employ an additional step. This step is to stand the rinsed sheet on a substantially horizontal surface for drying. The surface may have a moisture absorbing material on its surface to contain dripping water to a localized region.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

I claim:

1. A urine shield for use with a toilet having a toilet bowl with a front, a rear, a diameter, a top surface with a ledge and curved interior side surface beginning under the ledge, comprising:

a unified single piece flexible plastic sheet having a top and a bottom, a top width and a bottom width that are sufficient to permit the sheet to partly encircle the bowl of the toilet, four corners regions, a left portion having a bottom left end, a center portion, a right portion having a bottom right end, a height, and a flexibility that permits the sheet to be compression-fitted to the inside of the bowl without any use of fixtures, affixed ledgers, or right angle protrusions, the sheet, further comprising:

a left flange sloping outward from the bottom of the left portion to the center portion with a length that decreases as the flange extends from the bottom left end to the center portion and extending at an angle less than perpendicular but more than parallel from the left portion, a right flange sloping outward from the bottom of the right portion to the center portion with a length that decreases as the flange extends from the bottom right end to the center portion and extending at an angle less than perpendicular but more than parallel from the right portion, and a thickness sufficiently thin to permit hand bending of the sheet to fit into the toilet bowl and sufficiently thick to permit relaxation of the sheet to compression-fit it in the bowl.

2. The urine shield of claim 1 wherein the height of the sheet is between 12 inches (25 cm) and 20 inches (50 cm) and the sheet extends above the top surface of the bowl for a distance of between 8 inches (20 cm) and 16 inches (40 cm) to minimize splashing of urine outside the toilet and decrease unwieldiness of the urine shield during handling.

3. The urine shield of claim 1 wherein the width is sufficient to allow the center portion to contact the inner surface of the bowl, both flanges to catch under the ledge of the top surface of the toilet bowl and provide an opening to the front of the toilet of at least 25 percent of the diameter of the top of the toilet bowl and no more than 50 percent of the diameter of the top of the toilet bowl.

4. The urine shield of claim 1 wherein the width is sufficient to allow the center portion to contact the inner surface of the bowl, both flanges to catch under the ledge of the top surface of the toilet bowl and provide an opening to the front of the toilet of at least 30 percent of the diameter of the top of the toilet bowl and no more than 40 percent of the diameter of the top of the toilet bowl.

5. The urine shield of claim 1 wherein the width is between 20 inches (50 cm) and 30 inches (75 cm) at the top and decreases toward the bottom from between 10 and 25 percent.

6. The urine shield of claim 1 wherein each flange has a tapered length.

7. The urine shield of claim 1 wherein each flange has a maximum length sufficient to extend under the ledge and not push the sheet away from the bowl by more than 0.5 inches (13 mm).

8. The urine shield of claim 1 wherein each flange has a maximum length of between 0.5 inches (13 mm) and 1.5 inches (38 mm).

9. The urine shield of claim 1 wherein the sheet further comprises at least one hole near its top that can be used for hanging the shield on a hook attaches to a substantially vertical surface.

10. The urine shield of claim 1 wherein the sheet further comprises at least two holes near its top that can be used as handholds.

11. The urine shield of claim 1 sheet further comprises a shape having a curvature about a vertical axis that is less than the curvature of the top of the toilet to permit a compression fit in the bowl of a toilet.

12. The urine shield of claim 1 sheet further comprises a target indicia affixed to the lower region of the center portion.

13. A urine shield for use with a toilet having a toilet bowl with a front, a rear, a diameter, a top surface with a ledge and curved interior side surface beginning under the ledge, comprising:

a unified single piece flexible plastic sheet having a top and a bottom, a top width, a bottom width, four corners regions, a left portion having a bottom left end, a center portion, a right portion having a bottom right end, a height that extends above the top surface of the bowl for a distance of between 8 inches (20 cm) and 16 inches (40 cm), and a flexibility that permits the sheet to be compression-fitted to the inside of the bowl without any use of fixtures, affixed ledgers, or right angle protrusions, the sheet, further comprising:

a left flange sloping outward from the bottom of the left portion to the center portion with a length that decreases as the flange extends from the bottom left end to the center portion and extending at an angle less than perpendicular but more than parallel from the left portion, a right flange sloping outward from the bottom of the right portion to the center portion with a length that decreases as the flange extends from the bottom right end to the center portion and extending at an angle less than perpendicular but more than parallel from the right portion, and a thickness sufficiently thin to permit hand bending of the sheet to fit into the toilet bowl and sufficiently thick to permit relaxation of the sheet to compression-fit it in the bowl, and the width are sufficient to allow the center portion to contact the inner surface of the bowl, both flanges to catch under the ledge of the top surface of the toilet bowl and provide an opening to the front of the toilet of at least 25 percent of the diameter of the top of the toilet bowl and no more than 50 percent of the diameter of the top of the toilet bowl.

14. A method of using a urine shield for toilets, comprising the steps of:

a. providing a urine shield for use with a toilet having a toilet bowl with a front, a rear, a diameter, a top surface with a ledge and curved interior side surface beginning under the ledge, comprising:

a unified single piece flexible plastic sheet having a top and a bottom, a top width, a bottom width that are sufficient to permit the sheet to partly encircle the bowl of the toilet, four corners regions, a left portion having a bottom left end, a center portion, a right portion having a bottom right end, a height, and a flexibility that permits the sheet to be compression-fitted to the inside of the bowl without any use of fixtures, affixed ledgers, or right angle protrusions, the sheet, further comprising:

i. a left flange sloping outward from the bottom of the left portion to the center portion with a length that decreases as the flange extends from the bottom left end to the center portion and extending at an angle less than perpendicular but more than parallel from the left portion, ii. a right flange sloping outward from the bottom of the right portion to the center portion with a length that decreases as the flange extends from the bottom right end to the center portion and extending at an angle less than perpendicular but more than parallel from the right portion, and iii. a thickness sufficiently thin to permit hand bending of the sheet to fit into the toilet bowl and sufficiently thick to permit relaxation of the sheet to compression-fit it in the bowl;

b. pressing the sides of the sheet inward sufficiently to fit the flanges within the bowl of the toilet while lowering the bottom of the urine shield below the top ledge of the toilet; and c. releasing the shield to permit at least a portion of each flange to catch under the top ledge and the center portion to settle against surface of the toilet bowl at the rear of the toilet bowl.

15. The method of claim 14, further comprising the steps of:

d. pressing the sides of the sheet inward sufficiently to remove the flanges from under the top ledge of the toilet bowl, e. removing the sheet from the toilet bowl, f. rinsing the sheet with water.

16. The method of claim 15 wherein the water source is a running faucet.

17. The method of claim, 15 wherein the water source is a standing container of water containing at least one cleaning composition.

18. The method of claim 15, wherein the urine shield further comprises at least one hole near its top that can be used for hanging the shield on a hook that attaches to a substantially vertical surface and the method further comprising the step of:

g. suspending the rinsed sheet on the hook for drying.

19. The method of claim 15, wherein the urine shield further comprises a shape having a curvature about a vertical axis that is less than the curvature of the top of the toilet to permit a compression fit in the bowl of a toilet and the method further comprising the step of:

h. standing the rinsed sheet on a substantially horizontal surface for drying.

* * * * *